US010139126B2

(12) United States Patent
Hossameldin

(10) Patent No.: US 10,139,126 B2
(45) Date of Patent: Nov. 27, 2018

(54) AIRBORNE NOISE REDUCTION SYSTEM AND METHOD

(71) Applicant: University of Dammam, Dammam (SA)

(72) Inventor: Hany Hossameldin, Dammam (SA)

(73) Assignee: University of Dammam, Dammam (SA)

( * ) Notice: Subject to any disclaimer, the term of this patent is extended or adjusted under 35 U.S.C. 154(b) by 0 days.

(21) Appl. No.: 15/290,288

(22) Filed: Oct. 11, 2016

(65) Prior Publication Data

US 2018/0100670 A1 Apr. 12, 2018

(51) Int. Cl.
*F24F 13/24* (2006.01)
*G10K 11/162* (2006.01)
(Continued)

(52) U.S. Cl.
CPC ..... *F24F 13/24* (2013.01); *G10K 11/161* (2013.01); *G10K 11/162* (2013.01); *F24F 2013/242* (2013.01)

(58) Field of Classification Search
CPC ..... F24F 13/24; F24F 2013/242; F24F 7/00; F24F 7/10; F16L 55/02736;
(Continued)

(56) References Cited

U.S. PATENT DOCUMENTS 1,084,883 A * 1/1914 Holzwarth ..... F01N 1/08 181/264
1,682,316 A * 8/1928 Leustig et al. ..... F01N 1/083 181/281
(Continued)

FOREIGN PATENT DOCUMENTS

GB 2 266 340 A 10/1993
JP 3208046 B2 7/2001
(Continued)

OTHER PUBLICATIONS

"Acoustics—Measurement of sound insulation in buildings and of building elements—Part 4: Field measurements of airborne sound insulation between rooms", www.iso.org/obp/ui/#iso:std:iso:140:-4:ed-2:v1:en, ISO 140-4, 1998, 4 pages.
(Continued)

*Primary Examiner* — Edgardo San Martin
(74) *Attorney, Agent, or Firm* — Oblon, McClelland, Maier & Neustadt, L.L.P.

(57) ABSTRACT

An airborne noise reduction device includes a fixed-volume container having two opposing flat ends and two opposing symmetrical non-flat sides; an inlet port configured to face into a first room; an outlet port configured to face into a return air system; a diverter centrally mounted within an inside chamber to the two opposing flat ends of the fixed-volume container; and acoustic insulative material affixed to surfaces of the two opposing flat ends, the two opposing symmetrical non-flat sides, and the diverter within the inside chamber, wherein a combination of a geometry of the fixed-volume container and an absorption coefficient of the acoustic insulative material is configured to reduce an apparent sound index value of a sound source emanating from a second room connected to the return air system and received into the first room.

11 Claims, 14 Drawing Sheets

(51) Int. Cl.
*G10K 11/16* (2006.01)
*F24F 13/00* (2006.01)

(58) Field of Classification Search
CPC ..... F16L 55/0336; F01N 1/24; F01N 1/083; F01N 1/10; F01N 1/082; B60H 2001/006
See application file for complete search history.

(56) References Cited

U.S. PATENT DOCUMENTS 1,772,589 A * 8/1930 Beamer ..... F01N 1/08 181/265
2,990,906 A * 7/1961 Audette ..... F01N 1/085 181/256
3,059,564 A * 10/1962 Curran ..... F24F 3/0522 181/224
3,085,647 A * 4/1963 Jenn ..... F16L 55/02736 181/224
3,110,357 A * 11/1963 Jenn ..... F24F 7/025 181/224
3,211,177 A * 10/1965 Phillips ..... F24F 3/0522 137/607
3,452,667 A * 7/1969 Herb ..... F24F 13/06 181/256
3,568,791 A * 3/1971 Luxton ..... F24F 13/24 181/224
3,704,763 A * 12/1972 Becker ..... F01N 1/084 181/268
4,660,676 A * 4/1987 Eustace ..... F24F 13/24 181/224
4,809,812 A * 3/1989 Flugger ..... F01N 1/083 181/265
5,936,210 A * 8/1999 Borneby ..... F01N 1/10 181/256
6,374,944 B1 * 4/2002 Curl, Jr. ..... F01D 25/30 181/222
7,503,426 B2 * 3/2009 Yaoita ..... F01N 1/06 181/224
7,549,512 B2 * 6/2009 Newberry ..... F01N 1/08 181/264
8,240,427 B2 * 8/2012 Jangili ..... F01D 25/30 181/222
8,820,414 B2 * 9/2014 Mathiesen ..... E21B 34/08 166/332.1
2009/0133957 A1 * 5/2009 Owens ..... E04F 17/04 181/224
2012/0273298 A1 * 11/2012 Seryi ..... B60H 1/00564 181/224
2014/0124165 A1 * 5/2014 Moore ..... F24F 13/12 165/57
2016/0265706 A1 * 9/2016 Novellani ..... F02M 37/0041

FOREIGN PATENT DOCUMENTS

KR 20-2016-0000838 U 3/2016
WO WO 2009/071963 A1 6/2009

OTHER PUBLICATIONS

"Acoustics—Rating of sound insulation in buildings and of building elements—Part 1: Airborne sound insulation", www.iso.org/obp/ui/#iso:std:iso:717:-1:ed-3:v1:en, ISO 717-1, 2013, 3 pages.

* cited by examiner

| Frequency f Hz | R' 1/3 Octave dB |
|---|---|
| 50 | |
| 63 | |
| 80 | |
| 100 | 16.3 |
| 125 | 12.3 |
| 160 | 18.7 |
| 200 | 24.6 |
| 250 | 24.7 |
| 315 | 25.2 |
| 400 | 26.3 |
| 500 | 29.4 |
| 630 | 31.3 |
| 800 | 32.4 |
| 1000 | 33.1 |
| 1250 | 32.8 |
| 1600 | 31.5 |
| 2000 | 31.2 |
| 2500 | 32.0 |
| 3150 | 31.8 |
| 4000 | 32.5 |
| 5000 | 32.1 |

Rating according to ISO 717-1

$R'w\ (C;C_{tr}) = 31\ (-1;-4)$ dB $C_{50\text{-}3130}$ = N/AdB; $C_{50\text{-}5000}$ = N/AdB; $C_{100\text{-}5000}$ = -1dB;
$C_{tr,50\text{-}3130}$ = N/AdB; $C_{tr,50\text{-}5000}$ = N/AdB; $C_{tr,100\text{-}5000}$ = -4dB;

Evaluation based on field measurement results obtained in one-third-octave bands by an engineering method

| Frequency f Hz | R' 1/3 Octave dB |
|---|---|
| 50 | |
| 63 | |
| 80 | |
| 100 | 51.2 B |
| 125 | 49.5 B |
| 160 | 48.5 B |
| 200 | 44.9 B |
| 250 | 46.1 B |
| 315 | 45.9 B |
| 400 | 42.6 B |
| 500 | 42.7 |
| 630 | 39.2 |
| 800 | 44.2 B |
| 1000 | 42.7 |
| 1250 | 40.6 |
| 1600 | 48.9 B |
| 2000 | 45.4 |
| 2500 | 43.4 |
| 3150 | 48.7 B |
| 4000 | 49.4 B |
| 5000 | 49.6 B |

B: R' > = value shown measured R curve
reference curve
deviated R curve

Rating according to ISO 717-1

R'w (C;Ctr) = 44 (-1;-1) dB $C_{50\text{-}3150}$ = N/AdB; $C_{50\text{-}5000}$ = N/AdB; $C_{100\text{-}5000}$ = 0dB;
$C_{tr,50\text{-}3150}$ = N/AdB; $C_{tr,50\text{-}5000}$ = N/AdB; $C_{tr,100\text{-}5000}$ = -1dB;

Evaluation based on field measurement results obtained in one-third-octave bands by an engineering method

AIRBORNE NOISE REDUCTION SYSTEM AND METHOD

BACKGROUND

Airborne noise within a building affects many people to some extent, especially within an educational building, an office building, or a multiple-housing unit. Airborne noise can affect a person's focus and concentration, mental health and stress level, and privacy rights. A lack of acoustic regulation and enforcement can be a major cause of high levels of airborne noise. In addition, poor building design can also be a cause of high levels of airborne noise.

The "background" description provided herein is for the purpose of generally presenting the context of the disclosure. Work of the presently named inventors, to the extent it is described in this background section, as well as aspects of the description which may not otherwise qualify as conventional art at the time of filing, are neither expressly nor impliedly admitted as conventional art against the present disclosure.

SUMMARY

In one embodiment, an airborne noise reduction device includes a fixed-volume container having two opposing flat ends and two opposing symmetrical non-flat sides; an inlet port configured to face into a first room; an outlet port configured to face into a return air system; a diverter centrally mounted within an inside chamber to the two opposing flat ends of the fixed-volume container; and acoustic insulative material affixed to surfaces of the two opposing flat ends, the two opposing symmetrical non-flat sides, and the diverter within the inside chamber, wherein a combination of a geometry of the fixed-volume container and an absorption coefficient of the acoustic insulative material is configured to reduce an apparent sound index value of a sound source emanating from a second room connected to the return air system and received into the first room.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

The following descriptions are meant to further clarify the present disclosure by giving specific examples and embodiments of the disclosure. These embodiments are meant to be illustrative rather than exhaustive. The full scope of the disclosure is not limited to any particular embodiment disclosed in this specification, but rather is defined by the claims.

In the interest of clarity, not all of the features of the implementations described herein are shown and described in detail. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another.

An analysis of the different causes and sources of airborne and flanking noise can be implemented. The results can be compared to an international standard, such as ISO 140.

Airborne sound insulation can be characterized by an index, such as an Apparent Sound Reduction (R'w) index. R'w index can be calculated from parameters, such as an average sound level L1 of a source room, an average sound level L2 of a receiving room, a background noise level B2 of the receiving room, and an average reverberation time T2 of the receiving room.

Figure 1A:
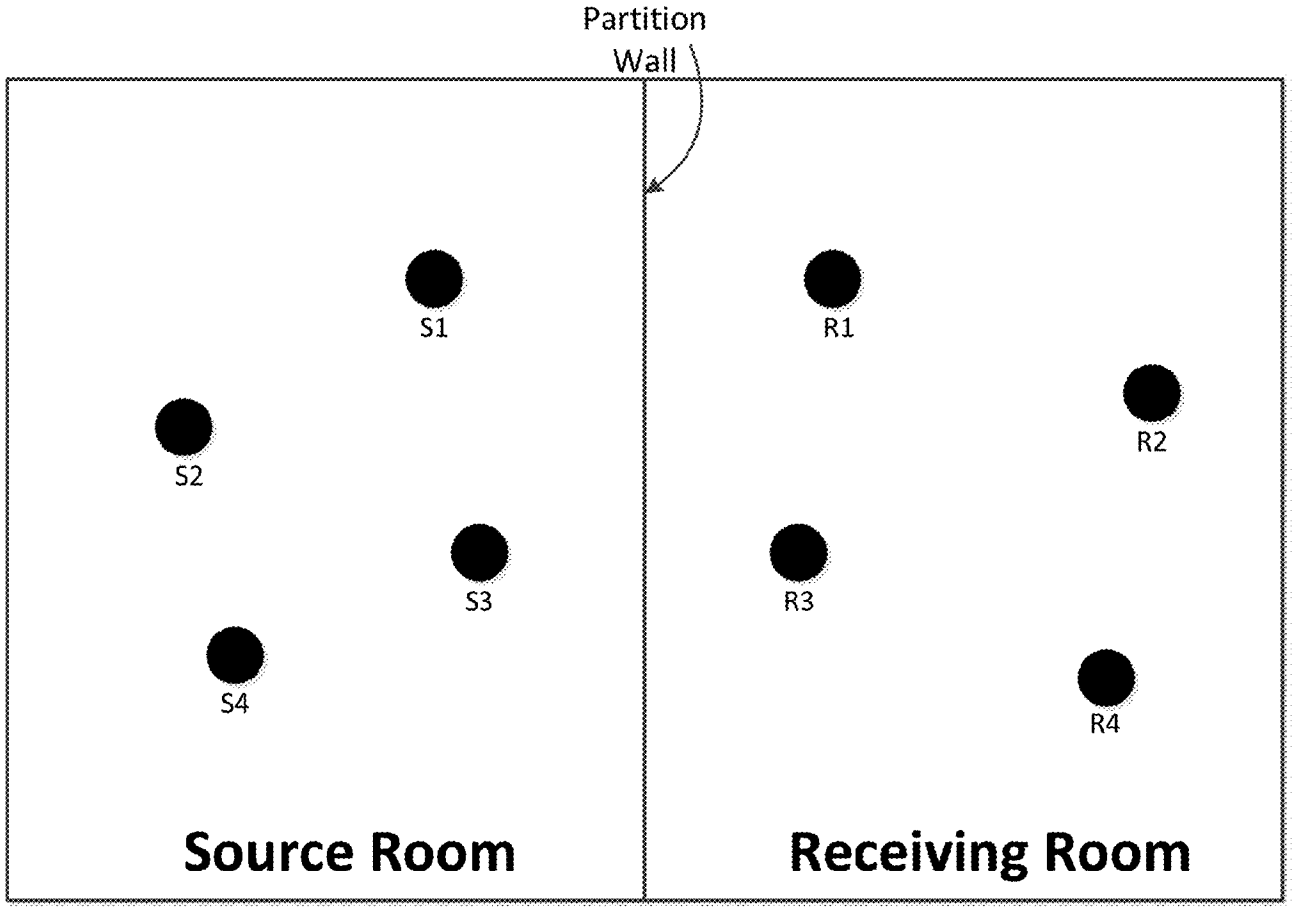
FIG. 1A illustrates an exemplary layout of a source room and a receiving room according to one embodiment.

FIG. 1A illustrates an exemplary layout of a source room and a receiving room. A plurality of positions for a sound source are illustrated as S1, S2, S3, and S4. However, less than four and more than four sound source positions are contemplated by embodiments described herein. FIG. 1A also illustrates a plurality of positions for measuring a received sound in the receiving room, illustrated as R1, R2, R3, and R4 from an associated sound source position in the source room. However, less than four and more than four sound receiving positions are contemplated by embodiments described herein.

A sound source can be an omnidirectional loudspeaker, which emits either pink or white noise, depending upon measurement conditions. The sound source can be placed in the source room to make L1 sound level measurements. Multiple measurement points should be used for the sound source, as well as a receiving microphone. In an embodiment, two loudspeaker sound source positions are used with a minimum of five microphone receiving positions. However, other numbers of loudspeaker source positions and microphone receiving positions can be used, which will depend in part on the size of the source room and the size of the receiving room. The L1 sound level measurement is a resulting average for positions of one to n, which is used to make sound insulation calculations.

Figure 1B:
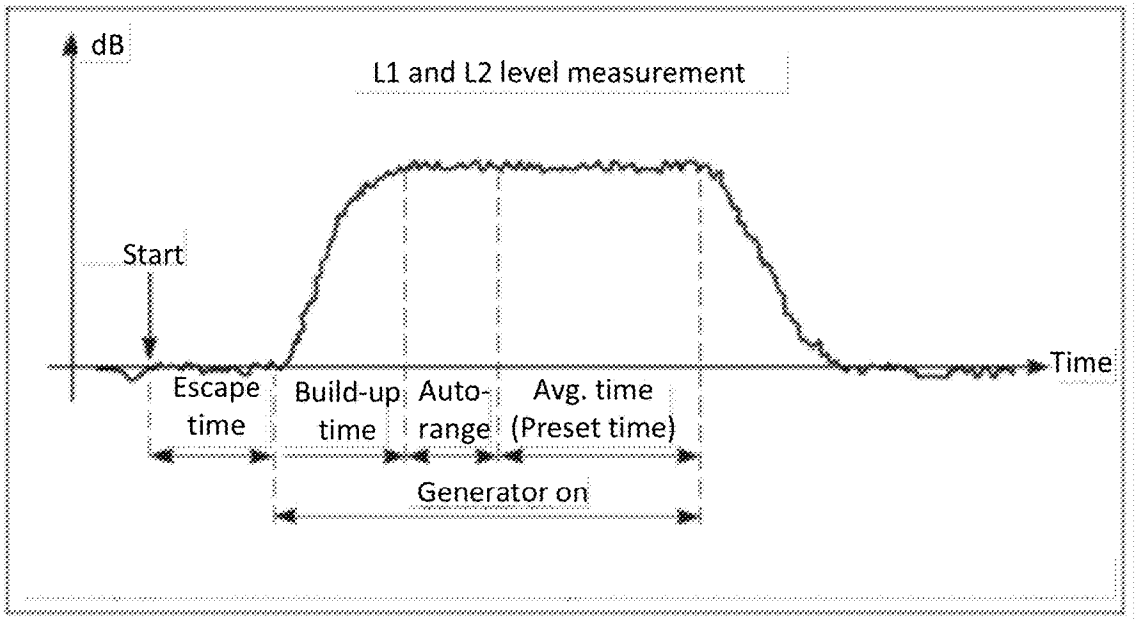
FIG. 1B illustrates a graph of different stages of an exemplary L1 and L2 measurement cycle according to one embodiment.

L2 sound level measurements can be a series of measurements taken at different positions in the receiving room, one for each sound source position in the source room, to allow for sound pressure variations. The resulting average spectrum can be used in the impact or airborne sound insulation calculations. A graph of different stages of an exemplary L1 and L2 measurement cycle are illustrated in FIG. 1B.

B2 sound level measurements can be taken in the receiving room, which are used to correct L2 sound levels. B2 sound levels are measured consecutively with L2 sound level measurements at the same measurement positions.

Figure 2:
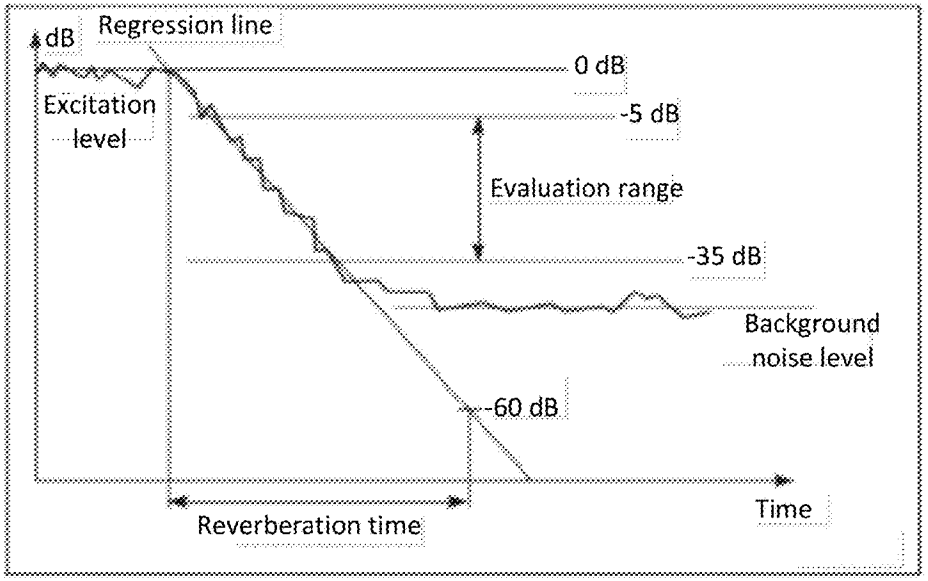
FIG. 2 is a graph illustrating how T2 can be measured according to one embodiment.

Reverberation time T2 is defined as the decay time for sound in a room after the excitation of the sound signal has stopped. In an embodiment, it is the time for a 60 dB drop in level. However, the decay can be evaluated over a 20 or 30 dB drop. The measurements within a 20 or 30 dB range can be used to make a regression line, which is extrapolated to a 60 dB range. FIG. 2 is a graph illustrating how T2 can be measured.

In building acoustics, T2 can be labeled either T20 or T30, depending upon which evaluation range was used, either 20 dB or 30 dB, respectively. A series of measurements are taken at different positions in the receiving room to allow for spatial variations of reverberation decay.

Figure 3:
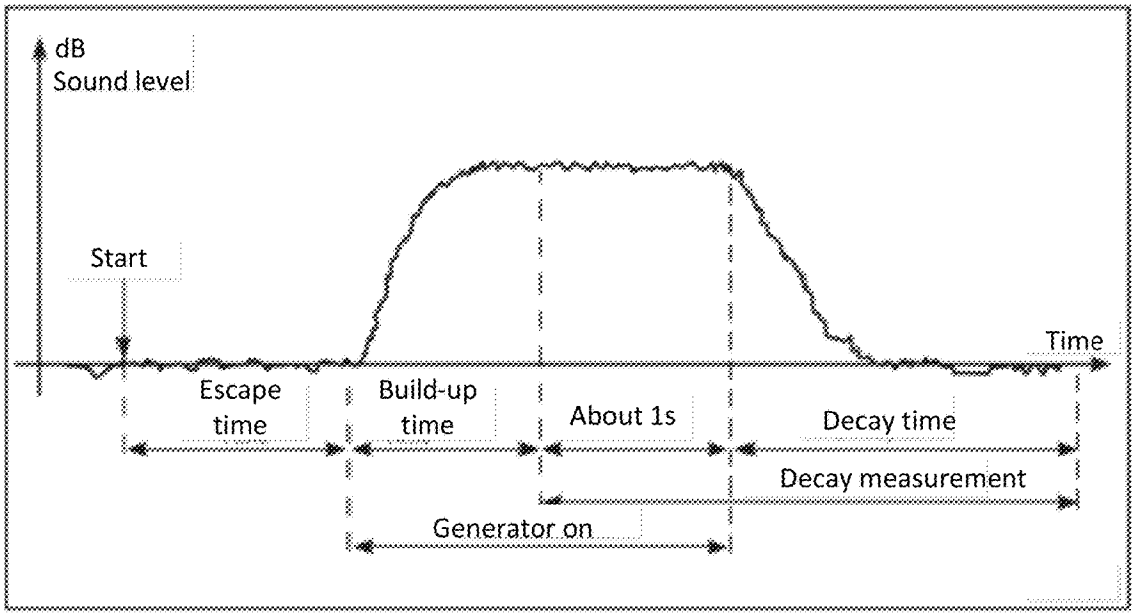
FIG. 3 is a graph illustrating a T2 measurement cycle using the interrupted noise method according to one embodiment.

A reverberation time measurement can be taken using an interrupted noise method or an impulse excitation method, for example. In the interrupted noise method, a loudspeaker sound source and a power amplifier are used. The reverberation time spectrum and its subsequent decay are measured and displayed. In the impulse excitation method, an impulsive source is used, such as a balloon or a starting pistol. After the balloon is popped or the pistol is fired, a reverberation time meter measures the decay. Decay curves for multiple frequency bands can be displayed, as well as the average reverberation time for selected frequency bands. FIG. 3 is a graph illustrating a T2 measurement cycle using the interrupted noise method.

Field measurements of the R'w index can be used in accordance with standards, such as ISO 140-4 to measure the airborne sound insulation performance of a room. The average sound pressure level in a room L for individual sound pressure levels, $L_j$ can be calculated as $$L=10\ \lg(1/n\ \Sigma_{j=1}^{n}10^{Lj/10})\text{dB}$$

The average sound pressure level of a room is taken as the logarithm base 10 of the ratio of the space and time average of the sound pressure squared to the square of a reference sound pressure. The space average is taken over the entire room with some exceptions, such as an area of direct radiation of a sound source or an area near a room boundary. The pressure level difference, D is a difference in the average sound pressure level $L_1$ in a source room and the average sound pressure level $L_2$ in a receiving room, wherein $$D=L_1-L_2$$

Ratings of the sound insulation in a building can be made using a standard, such as ISO 717-1. In an example, given for illustrative purposes only, a single-number quantity for an airborne sound insulation rating is a value, in decibels, of a reference curve measured at 500 Hz. A spectrum adaptation term can be added to the single-number rating to account for characteristics at a particular sound spectra, such as sound spectra defined in a one-third octave band or in a full octave band.

In an embodiment, R'w can be calculated in dBs by comparing values of R'w from 100 Hz to 4000 Hz with a defined reference curve. The defined reference curve is adjusted until requirements of a standard, such as ISO 140-4 are met. The R'w rating system can have one or more correction factors, such as C and Ctr, which are introduced to account for different spectra of noise sources. C relates to a higher frequency noise, while Ctr relates to a lower frequency noise. The correction factors are used to indicate the performance drop in corresponding frequency ranges. For example, R'w (C, Ctr)=55 (−1, −4) indicates a sound transmission loss of 55−4=51 dB if the incident noise was predominantly a low frequency noise. R'w indicates a sound transmission loss of 55−1=54 dB if the incident noise was predominantly a high frequency noise.

R'w can be calculated as ten times the logarithm base 10 of the ratio of the sound power $W_1$, which is incident on a partition under test, to the total sound power transmitted into the receiving room. This condition is true if the sound power $W_2$ transmitted through the separating element and the sound power $W_3$, transmitted through flanking elements or by other components is significant. It is expressed in decibels as $$R'w = 10\lg\left[\frac{W1}{W2+W3}\right]\text{dB}$$

In an embodiment, measurements of a sound pressure level (SPL) are made in four randomly chosen positions in the source room and the receiving room for each loud speaker position. L1 measurements are not made in close proximity to the loud speaker. A sound level meter is positioned at least one meter away from a room boundary or diffuser and at least one meter away from the loud speaker source. Each measurement position is at least 0.7 meters away from other measurement positions where practicable and on a different axis.

SPLs can be made in a one-third octave band from 100 Hz to 4000 Hz, for example. A correction is defined by the formula, Correction=10 log($T/T_o$) dB, where $T_o$=reference reverberation time, such as 0.5 seconds T=average reverberation time in the receiving room.

In an example, the required R'w (C, Ctr) value in educational spaces is equal to or greater than 43 dB.

An example of equipment and accessories used to perform airborne measurements is given herein for illustrative purposes only. Other systems of equipment and accessories are contemplated by embodiments described herein and are dependent upon in part, by the size and configurations of the rooms. An airborne measurement system includes a sound source, a power amplifier, an analyzer such as a hand-held analyzer, a computing device, and an output display. One or more types of building acoustics software can be used to enable an analysis of building acoustics obtained by the analyzer. A measurement suite can also be used to provide data viewing and post-processing, which can provide an efficient route from measurement data to a finished report. A quantifier software tool can also be used for viewing, post-processing, documenting, and archiving sound insulation measurements made with various sound level meters. The quantifier software tool can assist with calculating and reporting airborne, façade (i.e. the science of resolving aesthetic, environmental, and structural issues to achieve an effective enclosure in a building), and impact sound insulation data according to a variety of national and international standards.

Figure 4:
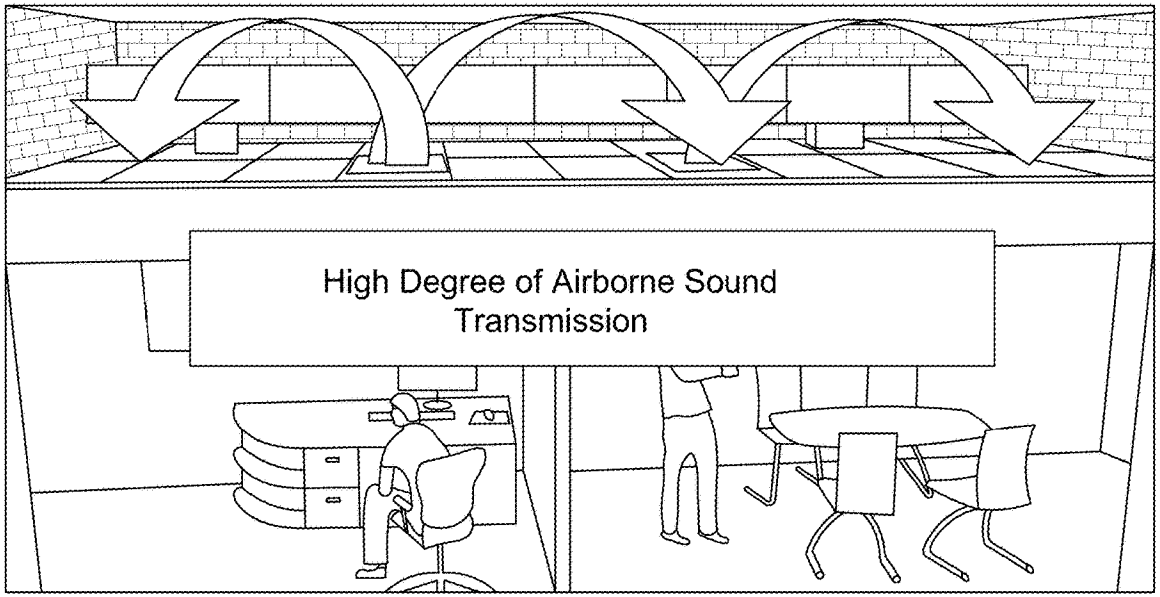
FIG. 4 illustrates an overhead perspective view of an exemplary ceiling return air system according to one embodiment.

FIG. 4 illustrates an overhead perspective view of an exemplary ceiling return air system. FIG. 4 illustrates just two rooms for simplicity. However, several more rooms can be connected to the same ceiling return air system. In a conventional ceiling return air system, airborne noise can travel between adjoining rooms and even non-adjacent rooms. The source of airborne noise can cause an intrusion into other rooms connected to the same ceiling return air system causing a disturbance in communication to the noise-receiving room, a loss of concentration by those experiencing the airborne noise, and a possible breach in privacy experienced by the source of the airborne noise.

Embodiments herein describe an airborne noise reduction device. The airborne noise reduction device can be used with various ceiling return air systems, as well as ceiling and wall ventilation systems of a building to reduce occupant and flanking noise between rooms connected by the ceiling return air system or the ventilation system.

Figure 5A:
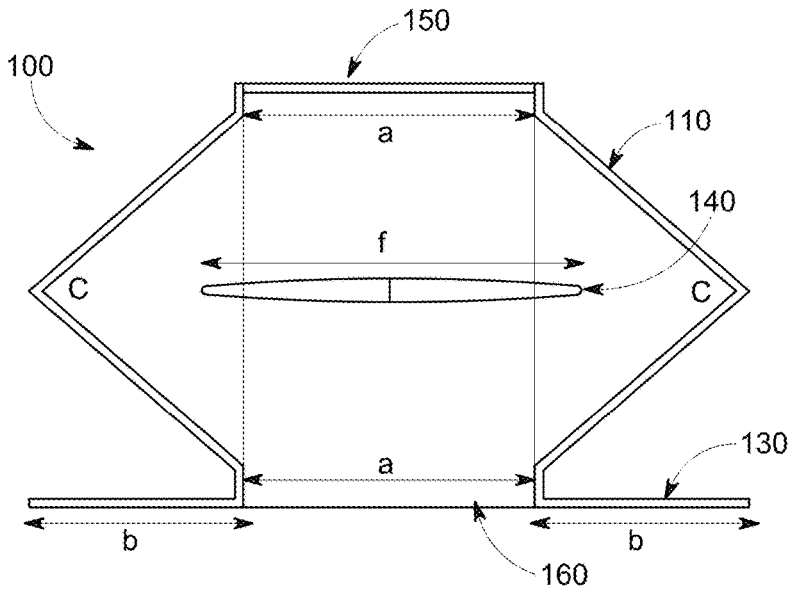
FIG. 5A illustrates a side view of an airborne noise reduction device according to one embodiment.

FIG. 5A illustrates a side view of an airborne noise reduction device 100 according to embodiments described herein. The side view of airborne noise reduction device 100 illustrates two opposing and symmetrical wedge-shaped sides 110 having an angle of C degrees. Angle C can be at or near ninety degrees. However, angles of more or less than ninety degrees can be used with embodiments described herein. In another embodiment, angle C can be 105 degrees. An air output vent 150 of diameter a and an air input vent 160 of diameter a are illustrated at a respective top side and bottom side of airborne noise reduction device 100 in FIG. 5A. However, the diameter of air output vent 150 can be different from the diameter of air input vent 160. In addition, air output vent 150 and air input vent 160 can be of various geometries, such as square, rectangular, circular, or oval.

FIG. 5A also illustrates an air flow diverter 140 of diameter f, which is centrally-situated between the two wedge-shaped sides 110. Two opposing sides of the air flow diverter 140 are situated within the wedge of the wedge-shaped sides 110. However, the air flow diverter 140 is not connected to the wedge-shaped sides 110. Flanges 130 of diameter b extend from a bottom side of airborne noise reduction device 110. The flanges 130 are used to connect the airborne noise reduction device 100 within a vent of a return air system or a ventilation system. The diameter b of flanges 130 can vary according to a size of ceiling tiles or a wall-mounting area to which the flanges 130 are to be attached.

The structural shell of airborne noise reduction device 100 can be constructed from a wood material, such as plywood. However, other materials such as plastic, metal, fiberglass, and aluminum are contemplated by embodiments described herein.

Figure 5B:
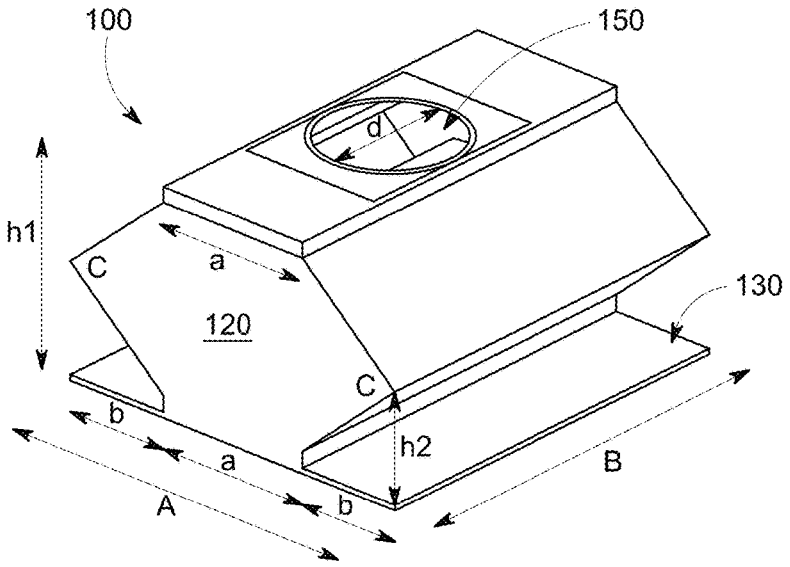
FIG. 5B illustrates a perspective view of an airborne noise reduction device according to one embodiment.

FIG. 5B illustrates a perspective view of airborne noise reduction device 100. FIG. 5B illustrates two flat ends 120 (the back flat end 120 is hidden from view) that connect with the two wedge-shaped sides 110. The diameter A of airborne noise reduction device 100 is the combined diameter of diameter a of the air input vent 160 and diameters b of the two flanges 130. The length of airborne noise reduction device 100 is illustrated as B. Diameter A can be equal to or different from length B. The height of airborne noise reduction device 100 is illustrated as h1, and the height from the flange 130 to a tip of the corner of the wedge-shaped sides 110 is illustrated as h2. Diameter d is the size of a circular air output vent 150.

Various relationships exist between the dimensions of a, b, d, A, B, h1, and h2 and the angle of C. In an embodiment, designed to achieve maximum effectiveness, the following relationships can be used. However, the following relationships are given for illustrative purposes only.

$$a=A/2$$

$$b=A/4$$

$$d_{max}=A/2$$

$$h1=2A/3$$

$$h2=A/3$$

angle C=105 degrees $$f_{min}=A/2$$

$$f_{max}=2A/3$$

$$A_{max}=80 \text{ cm}$$

Other embodiments using different relationships from those illustrated herein are also contemplated. Output vent 150 dimensions depend upon the size of an associated return air duct size and geometry, such as a circular, oval, rectangular, or square geometry. In an embodiment, dimension a of output vent 150 can have a maximum opening size of 40 cm.

Figure 6A:
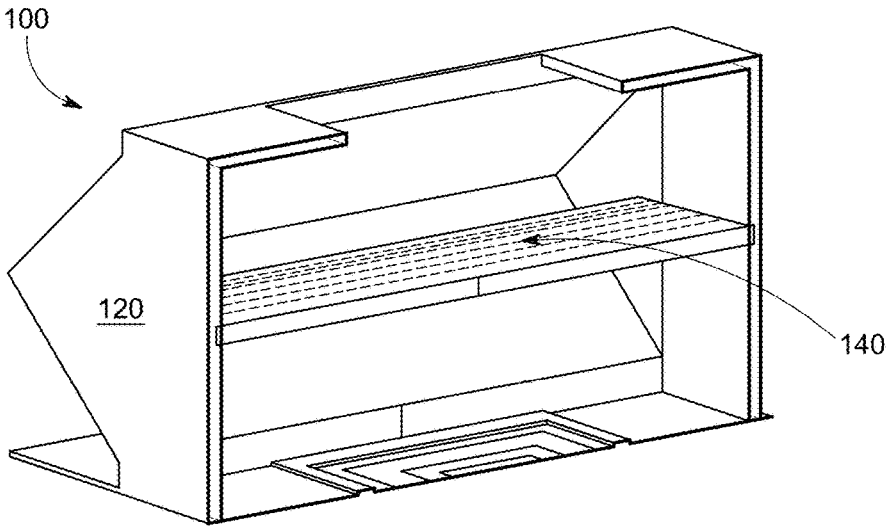
FIG. 6A illustrates a lengthwise cut-away view of an airborne noise reduction device according to one embodiment.
Figure 6B:
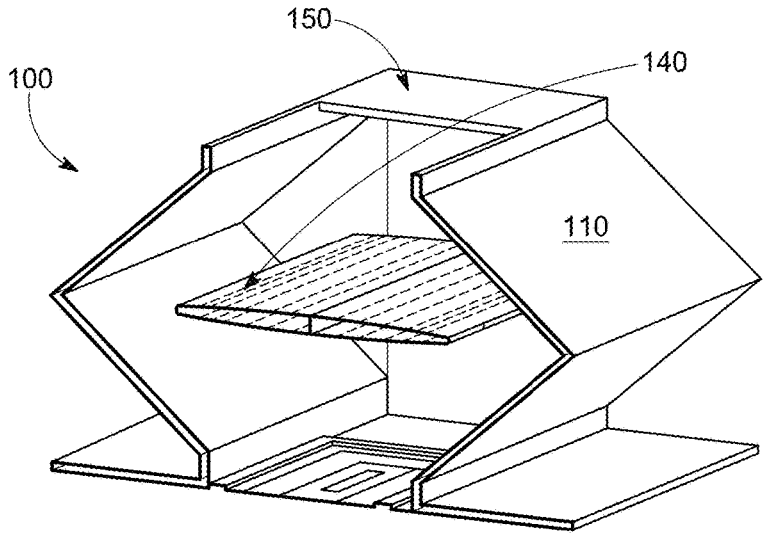
FIG. 6B illustrates a transverse cut-away view of an airborne noise reduction device according to one embodiment.

FIG. 6A illustrates a lengthwise cut-away view of airborne noise reduction device 100. FIG. 6B illustrates a transverse cut-away view of airborne noise reduction device 100. Two opposing sides of the air flow diverter 140 are situated within the wedge of the wedge-shaped sides 110, as illustrated in the transverse cut-away view of airborne noise reduction device 100. The other two opposing sides of the air flow diverter 140 are connected to the two flat ends 120, as illustrated in FIG. 6A. FIG. 6A illustrates a square or rectangular air output vent 150. However, the air output vent 150 can also be circular, as illustrated in FIG. 5B.

The airborne noise reduction device 100 has acoustic insulative material affixed to inside chamber surfaces of the wedge-shaped sides 110, the two flat ends 120, and both sides of the air flow diverter 140. The acoustic insulative material is selected such that the airborne noise of a return air system is reduced. Acoustic insulative materials include, but are not limited to rock wool, soundproof foam, and glass wool. A specific acoustic insulative material can be selected according to the desired sound reduction index.

The thickness of the acoustic insulative material and the method of application can also be modified to accommodate different types, layouts, and sizes of a return air system. Increasing the material sound absorption coefficient will increase the sound reduction index. The sound absorption coefficient is derived from a process in which a material, structure, or object absorbs sound energy when sound waves are encountered, as opposed to reflecting the sound energy.

Sound absorption coefficients are known for various materials at different frequency levels. Table 1 illustrates the sound absorption coefficient for some materials at 125Hz, 250 Hz, 500 Hz, 1000 Hz, 2000 Hz, and 4000 Hz.

TABLE 1

| Sound Absorption Coefficients | | | | | | |
|---|---|---|---|---|---|---|
| | Coefficients | | | | | |
| | 125 Hz | 250 Hz | 500 Hz | 1000 Hz | 2000 Hz | 4000 Hz |
| Materials | | | | | | |
| Brick - Unglazed | .03 | .03 | .03 | .04 | .05 | .07 |
| Brick - Unglazed, Painted | .01 | .01 | .02 | .02 | .02 | .03 |
| Carpet - Heavy, on Concrete | .02 | .06 | .14 | .37 | .60 | .65 |
| Carpet - Heavy, on 40 oz Hairfelt or Foam Rubber on Concrete | .08 | .24 | .57 | .69 | .71 | .73 |
| Carpet - Heavy, with Impermeable Latex Backing on 40 oz Hairfelt or Foam Rubber on Concrete | .08 | .27 | .39 | .34 | .48 | .63 |
| Concrete Block - Light, Porous | .36 | .44 | .31 | .29 | .39 | .25 |
| Concrete Block - Dense, Painted | .10 | .05 | .06 | .07 | .09 | .08 |
| Gypsum Board - ½", Nailed to 2 × 4, 16" O.C. | .29 | .10 | .05 | .04 | .07 | .09 |
| Marble or Glazed Tile | .01 | .01 | .01 | .01 | .02 | .02 |
| Plaster - Gypsum, or Lime, Smooth Finish on Tile or Brick | .013 | .015 | .02 | .03 | .04 | .05 |
| Plaster - Gypsum, or Lime, Rough Finish on Lath | .14 | .10 | .06 | .05 | .04 | .03 |
| Plaster - Gypsum, or Lime, Smooth Finish on Lath | .14 | .10 | .06 | .04 | .04 | .03 |
| Plywood Paneling - ⅜" Thick | .28 | .22 | .17 | .09 | .10 | .11 |
| Fabrics | | | | | | |
| Light Velour - 10 oz/sq yd, Hung Straight, in Contact with Wall | .03 | .04 | .11 | .17 | .24 | .35 |
| Medium Velour - 14 oz/sq yd, draped to half area | .07 | .31 | .49 | .75 | .70 | .60 |
| Heavy Velour - 18-oz/sq yd, Draped to Half Area | .14 | .35 | .55 | .72 | .70 | .65 |

A Noise Reduction Coefficient (NRC) can also be calculated. The NRC is calculated by averaging how absorptive a material is at four different frequencies of 250 Hz, 500 Hz, 1000 Hz, and 2000 Hz. Table 2 illustrates the sound absorption coefficients and the NRC for an exemplary material used with embodiments described herein.

TABLE 2

| Sound Absorption Coefficients for Arabian Fibreglass Insulation Co. | | | | | | | | |
|---|---|---|---|---|---|---|---|---|
| Product | Sound | Absorption Coefficient At One Third Octave Center Frequencies (Hz) | | | | | | |
| Type | Thickness | 125 | 250 | 500 | 1000 | 2000 | 4000 | NRC |
| AQLI60 | 25 mm | 0.09 | 0.24 | 0.49 | 0.85 | 0.83 | 0.77 | 0.60 |

Arabian Fiberglass Insulation Company Ltd

The sound reduction index is used to measure the level of sound insulation provided by a structure, such as a wall between two rooms. The sound reduction index (R'w) is a single number rating of laboratory measurements in accordance with a standard, such as ISO 717-1. In an embodiment, a pressure level difference D is a difference in the average sound pressure level $L_1$ in a source room and the average sound pressure level $L_2$ in a receiving room, where $D=L_1-L_2$. As a result, increasing the insulation (i.e. the sound absorption coefficient) will increase the value of D and the value of the sound reduction index.

$$R'w=L_1-L_2+10\log(S/A)$$

where S=the area of $L_1$ and A=the equivalent absorption area of $L_2$. In an example, a desirable R'w value in educational spaces is equal to or greater than 43 dB.

Measurement of R'w according to ISO 140-1 gives frequency-dependent values. ISO 717-5 describes a method used for conversion of these values into a single number quantity. This characterizes the acoustical performance of a room under test, and is referred to as the weighted sound reduction index.

In an example, given for illustrative purposes only, the R'w value was measured for two adjacent rooms in which a noise source was located in a first room and the adjacent room was a noise receiving room. Table 3 summarizes the dimensions of the two rooms and the adjoining wall.

TABLE 3

| Dimensions of Adjacent Rooms and Separating Wall | | |
|---|---|---|
| Classroom # | Floor Area ($m^2$) | Volume ($m^3$) |
| 303 | 32.4 | 90.67 |
| 304 | 41.3 | 115.64 |
| Separating Wall | Area = 19.72 $m^2$ in both cases | |

Figure 7:
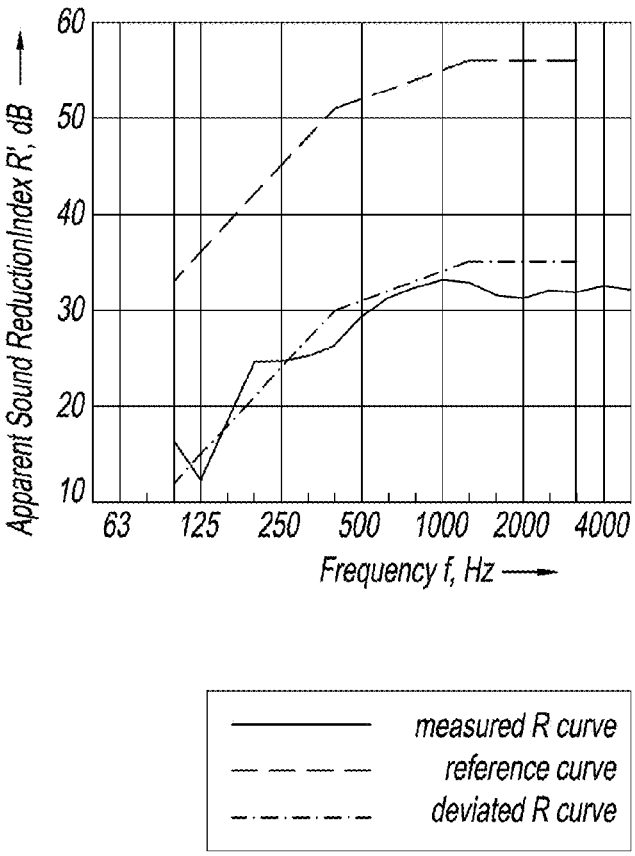
FIG. 7 is a graph illustrating the Apparent Sound Reduction (R'w) index between two rooms with no airborne noise reduction devices installed according to one embodiment.

The R'w was tested for a frequency range of 60 Hz to 4000 Hz without having an airborne noise reduction device 100 installed in a ventilation area shared by the two rooms. FIG. 7 is a graph illustrating the R'w index between the two rooms with no airborne noise reduction devices 100 installed in the ventilation area. The measured curve is compared to a reference curve. A deviation curve represents the measured curve that is shifted in steps of 1 dB until the mean unfavorable deviation of the measured curve is as large as possible, but not more than 2.0 dB. A R'w of 31 dB was calculated for the room specifications given in Table 3.

Figure 8:
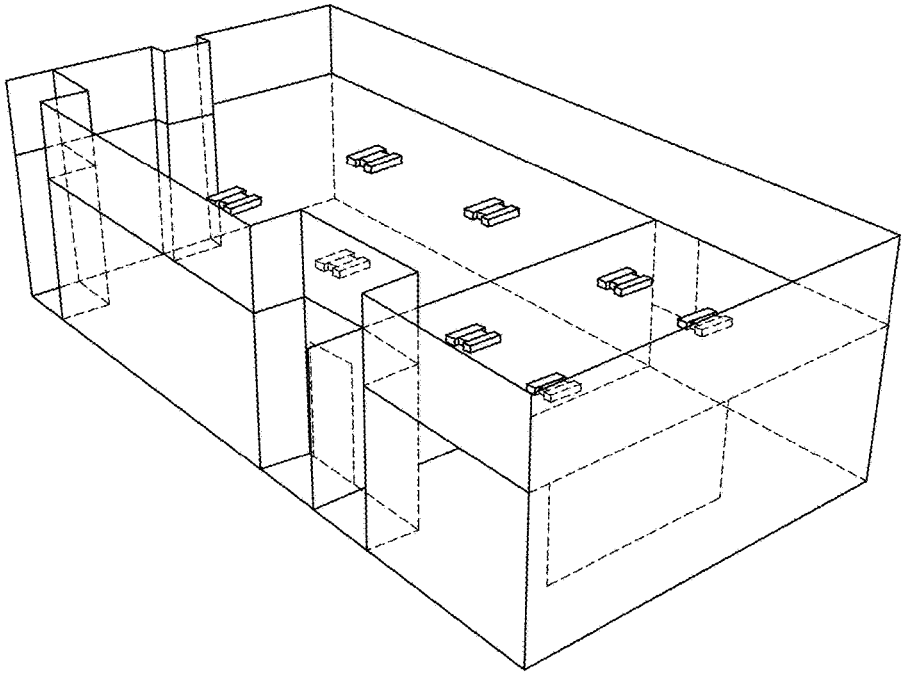
FIG. 8 is a perspective view of two adjacent rooms in which four airborne noise reduction devices are installed in the ceiling ventilation area according to one embodiment.

FIG. 8 is a perspective view of the two adjacent rooms in which four airborne noise reduction devices 100 were installed in the ceiling ventilation area of the source room and four airborne noise reduction devices 100 were installed in the ceiling ventilation area of the receiving room. The airborne noise reduction device 100 has an exemplary material, such as AQL 160 adhered to the inner chamber surfaces and air diverter 140.

Figure 9:
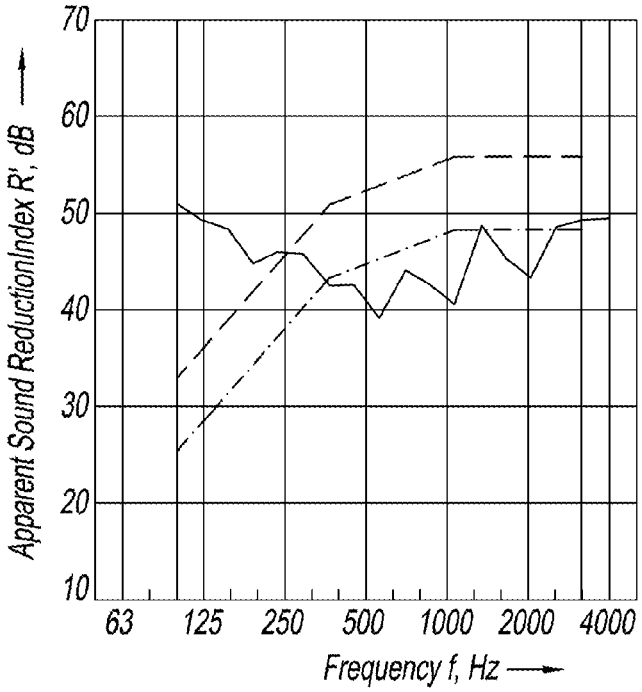
FIG. 9 is a graph illustrating the R'w index between two rooms with airborne noise reduction devices installed in the ventilation area according to one embodiment.

The calculated R'w, having the installed airborne noise reduction devices 100 was equal to 44 dB. FIG. 9 is a graph illustrating the R'w index between the two rooms with airborne noise reduction devices 100 installed in the ventilation area. The measured curve is compared to a reference curve. A deviation curve represents the measured curve that is shifted in steps of 1 dB until the mean unfavorable deviation of the measured curve is as large as possible, but not more than 2.0 dB. A dramatic increase in the R'w index was realized with the airborne noise reduction devices 100 installed in the ventilation area shared by the two rooms.

Figure 10:
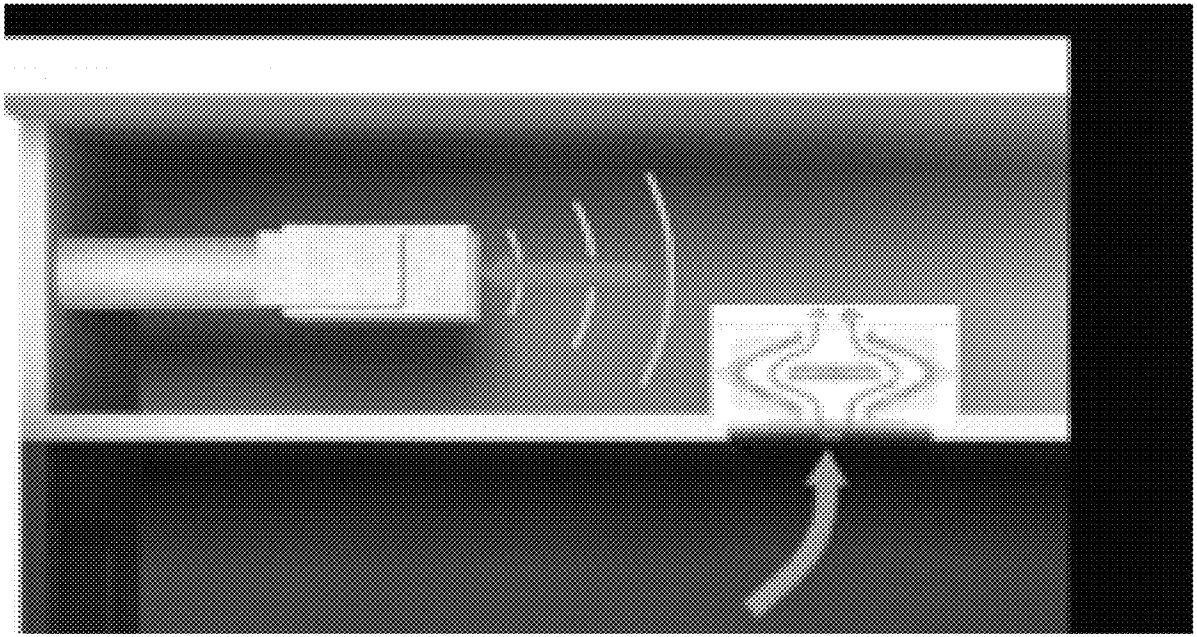
FIG. 10 illustrates installation of an airborne noise reduction device into a ceiling return air system according to one embodiment.

FIG. 10 illustrates installation of the airborne noise reduction device 100 into a ceiling return air system. The flanges 130 are used to connect the airborne noise reduction device 100 into a vent opening of the ceiling return air system. However, airborne noise reduction device 100 can also be mounted into a wall air or ventilation system to reduce noise, such as airborne noise from a kitchen or restroom.

Figure 11:
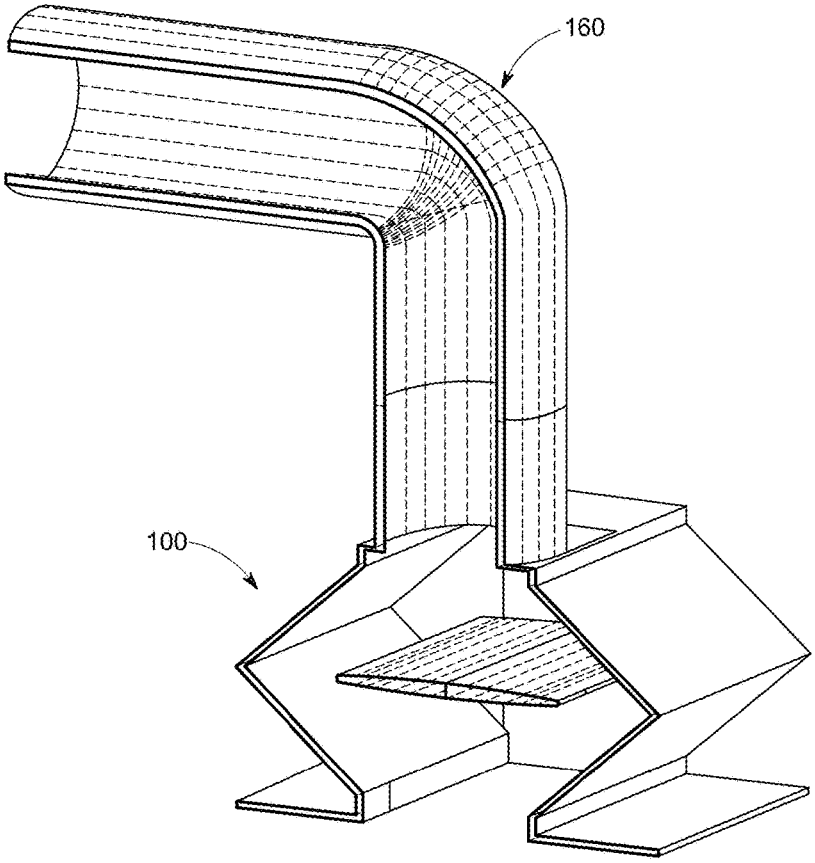
FIG. 11 illustrates an airborne noise reduction device connected to a return air duct according to one embodiment.

FIG. 11 illustrates airborne noise reduction device 100 connected to a return air duct 160 of an air return ceiling diffuser. In another embodiment, airborne noise reduction device 100 can also be connected to a return air duct 160 of an air return wall diffuser.

Figure 12:
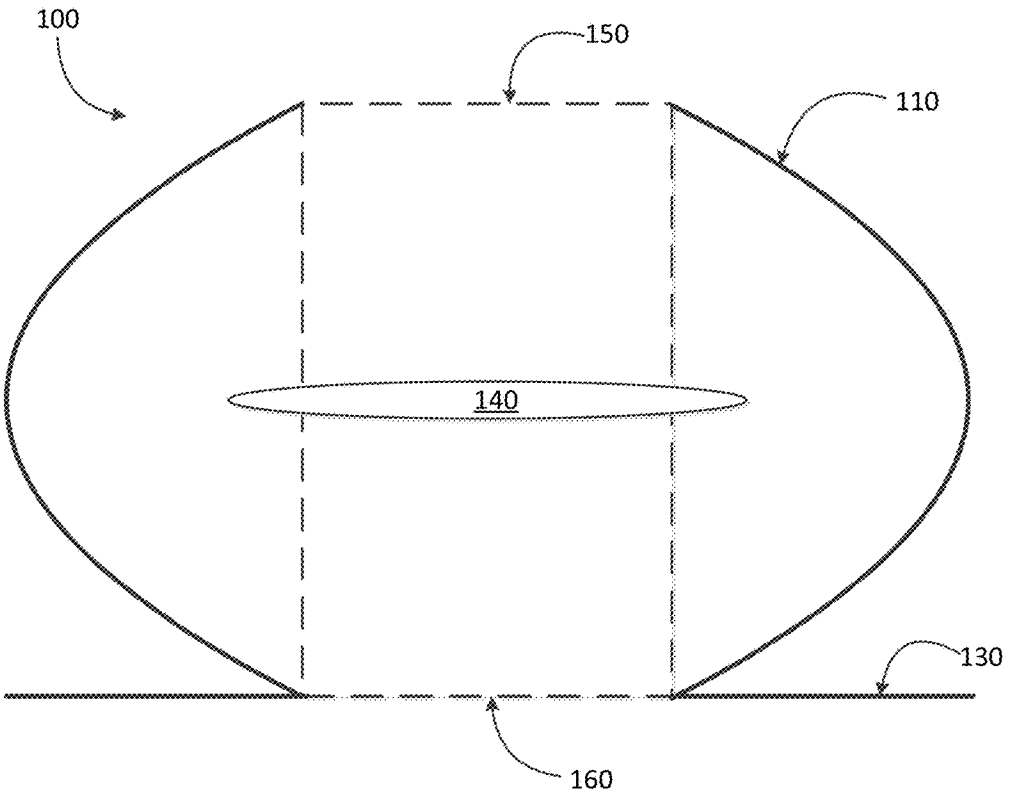
FIG. 12 illustrates rounded or oval-shaped sides of an airborne noise reduction device according to one embodiment.
Figure 13:
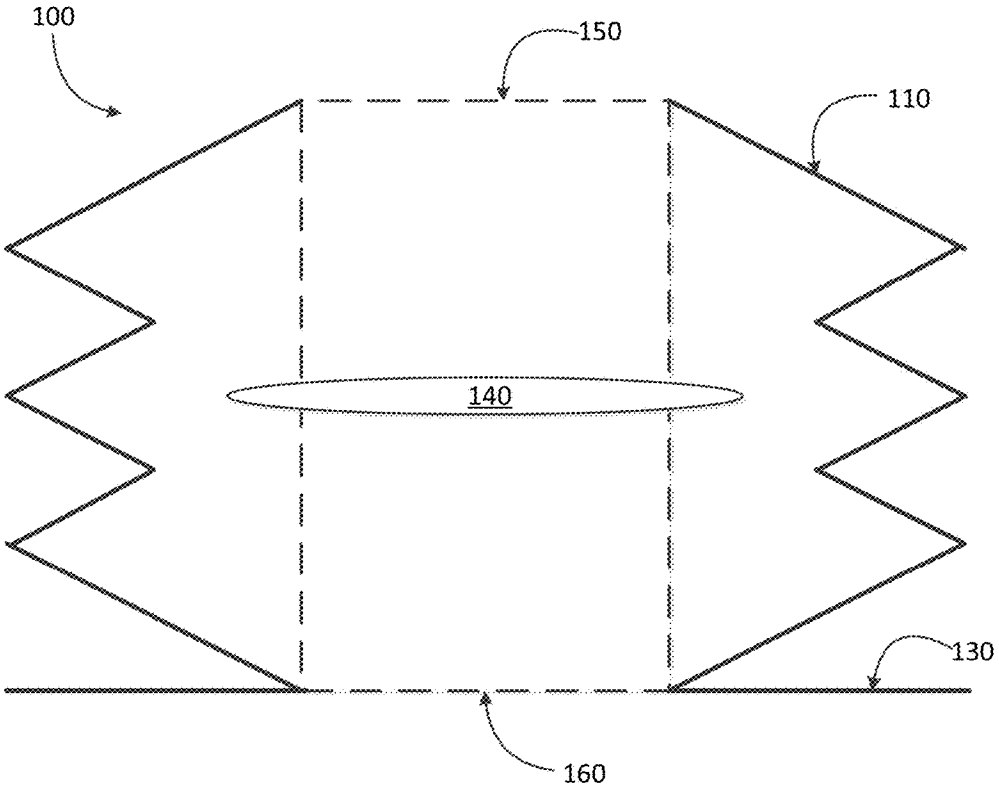
FIG. 13 illustrates multiple ridges of an airborne noise reduction device according to one embodiment.

A combination of geometry modification of the wedge-shaped sides 110 and modification of the acoustic insulative material can be configured to provide desired customized acoustic results, via the airborne noise reduction device 100. Geometry modifications include, but are not limited to varying the overall size of the airborne noise reduction device 100, and increasing or decreasing the angle as well as the length of the wedge-shaped sides 110. Other geometries include rounded or oval-shaped sides, as illustrated in FIG. 12, which would increase the air flow through the airborne noise reduction device 100 and thereby increase the sound absorption coefficient. Other geometries also include multiple ridges, as illustrated in FIG. 13, which would decrease the air flow through the airborne noise reduction device 100 and thereby decrease the sound absorption coefficient.

In addition to the type of insulative material, modifications to the acoustic insulative material include, but are not limited to varying the thickness of the insulative material within the inside chamber of the airborne noise reduction device 100, such as a thinner insulative material on a top surface of air flow diverter 140 and a thicker insulative material on a bottom surface of air flow diverter 140, or vice versa. There could also be a combination of different insulative materials used to form a hybrid of insulative materials within the inside chamber, such as Material A affixed to walls of the inside chamber and Material B affixed to air flow diverter 140.

The effectiveness of each customized modification can be determined, at least in part by measuring the sound absorption coefficient. Generated noise can be in the form of white noise, which has a uniform spectral power density at all frequencies, and pink noise. Pink noise has a power spectral density that falls at 3 dB/octave with rising frequency. Pink noise provides results that contain a constant energy per octave, such as $1/3^{rd}$ octave. In an example, the effectiveness of each customized modification can be measured at a one-third octave center frequency band of 0.09-0.77 with a NRC value of 0.60. The one-third octave center frequency band can be in the range of 125-4000 Hz.

An optimum combination of the type and thickness of the insulative material can be customized to obtain a desirable sound absorption coefficient and resulting R'w. In addition, the size and geometry of the airborne noise reduction device 100 can be varied to achieve a desirable sound absorption coefficient and resulting R'w. In particular, increasing or decreasing the angle as well as the length of the wedge-shaped sides 110 can be varied to achieve a desirable sound absorption coefficient and resulting R'w. In addition, round sides or multiple-ridged sides can be used in lieu of the wedge-shaped sides 110 to achieve a desirable sound absorption coefficient and resulting R'w.

Embodiments described herein include the following aspects.

(1) An airborne noise reduction device includes a fixed-volume container having two opposing flat ends and two opposing symmetrical non-flat sides; an inlet port configured to face into a first room; an outlet port configured to face into a return air system; a diverter centrally mounted within an inside chamber to the two opposing flat ends of the fixed-volume container; and acoustic insulative material affixed to surfaces of the two opposing flat ends, the two opposing symmetrical non-flat sides, and the diverter within the inside chamber, wherein a combination of a geometry of the fixed-volume container and an absorption coefficient of the acoustic insulative material is configured to reduce an apparent sound index value of a sound source emanating from a second room connected to the return air system and received into the first room.

(2) The airborne noise reduction device of (1), wherein the apparent sound index value is determined via a combination of a size of the first room, a size of the second room, a background noise level of the first room, and an average reverberation time of the sound source received into the first room.

(3) The airborne noise reduction device of either (1) or (2), wherein the fixed-volume container comprises a wood board material.

(4) The airborne noise reduction device of any one of (1) to (3), wherein the absorption coefficient of the acoustic insulative material is measured in a range of 0.09-0.77 at a one-third octave center frequency band.

(5) The airborne noise reduction device of any one of (1) to (4), wherein the one-third octave center frequency band is 125-4000 Hz.

(6) The airborne noise reduction device of any one of (1) to (5), wherein the outlet port is configured to face into a ceiling return air system.

(7) The airborne noise reduction device of any one of (1) to (6), wherein the outlet port is configured to face into a wall return air system.

(8) The airborne noise reduction device of any one of (1) to (7), wherein the two opposing symmetrical non-flat sides comprise an outward-facing wedge shape.

(9) The airborne noise reduction device of any one of (1) to (8), wherein the two opposing symmetrical non-flat sides comprise an outward-facing circular shape.

(10) The airborne noise reduction device of any one of (1) to (9), wherein the two opposing symmetrical non-flat sides comprise an outward-facing multiple-wedge shape.

(11) The airborne noise reduction device of any one of (1) to (10), wherein the acoustic insulative material comprises one of rock wool, soundproof foam, and glass wool.

(12) A method of reducing airborne noise, includes forming a fixed-volume container having two opposing symmetrical non-flat sides and two opposing flat ends; mounting an air flow diverter to the two opposing flat ends within an inside chamber of the fixed-volume container, wherein two unattached sides of the air flow diverter extend towards the two opposing symmetrical non-flat sides; affixing acoustic insulative material to surfaces of the two opposing symmetrical non-flat sides, the two opposing flat ends, and the air flow diverter within the inside chamber; and connecting an outlet port of the fixed-volume container to a return air system of a building, wherein an input port opposite to the outlet port faces into a first room connected to the return air system, wherein a geometry of the fixed-volume container and a property of the acoustic insulative material are adjusted to reduce an apparent sound index value of a sound source emanating from a second room connected to the return air system and received into the first room.

(13) The method of (12) further includes adjusting a thickness of the acoustic insulative material to obtain a desirable apparent sound index value.

(14) The method of either (12) or (13), wherein the two opposing symmetrical non-flat sides form an outward-facing wedge shape having a given angle.

(15) The method of any one of (12) to (14), wherein the given angle is in a range of 90-105 degrees.

(16) The method of any one of (12) to (15), wherein the two opposing symmetrical non-flat sides form an outward-facing circular shape.

(17) The method of any one of (12) to (16) further includes selecting the acoustic insulative material according to its absorption coefficient to obtain a desirable apparent sound index value.

(18) The method of any one of (12) to (17) further includes selecting the acoustic insulative material according to a sound frequency of the sound source to obtain the desirable apparent sound index value.

While certain embodiments have been described herein, these embodiments are presented by way of example only, and are not intended to limit the scope of the disclosure. Using the teachings in this disclosure, a person having ordinary skill in the art could modify and adapt the disclosure in various ways, making omissions, substitutions, and/or changes in the form of the embodiments described herein, without departing from the spirit of the disclosure. Moreover, in interpreting the disclosure, all terms should be interpreted in the broadest possible manner consistent with the context. The accompanying claims and their equivalents are intended to cover such forms or modifications, as would fall within the scope and spirit of the disclosure.

The invention claimed is:

1. An airborne noise reduction device, comprising:

a fixed-volume container having a top side and a bottom side, two opposing flat ends, and two opposing symmetrical outwardly-extending non-flat sides;

an inlet port located on the bottom side and configured to face into a first room;

an outlet port located on the top side and configured to face into a return air system;

a diverter within an inside chamber centrally mounted to the two opposing flat ends of the fixed-volume container, wherein a diameter of the diverter is greater than a diameter of the top side and greater than a diameter of the bottom side, and wherein the diverter extends into the two opposing symmetrical outwardly-extending non-fiat sides; and acoustic insulative material affixed to surfaces of the two opposing flat ends, the two opposing symmetrical non-flat sides, and the diverter within the inside chamber, wherein a combination of a geometry of the fixed-volume container and an absorption coefficient of the acoustic insulative material is configured to reduce an apparent sound index value of a sound source emanating from a second room connected to the return air system and received into the first room.

2. The airborne noise reduction device of claim 1, wherein the apparent sound index value is determined via a combination of a size of the first room, a size of the second room, a background noise level of the first room, and an average reverberation time of the sound source received into the first room.

3. The airborne noise reduction device of claim 1, wherein the fixed-volume container comprises a wood board material.

4. The airborne noise reduction device of claim 1, wherein the absorption coefficient of the acoustic insulative material is measured in a range of 0.09 -0.77 at a one-third octave center frequency band.

5. The airborne noise reduction device of claim 4, wherein the one-third octave center frequency band is 125-4000 Hz.

6. The airborne noise reduction device of claim 1, wherein the outlet port is configured to face into a ceiling return air system.

7. The airborne noise reduction device of claim 1, wherein the outlet port is configured to face into a wall return air system.

8. The airborne noise reduction device of claim 1, wherein the two opposing symmetrical non-flat sides comprise an outward-facing wedge shape.

9. The airborne noise reduction device of claim 1, wherein the two opposing symmetrical non-flat sides comprise an outward-facing circular shape.

10. The airborne noise reduction device of claim 1, wherein the two opposing symmetrical non-flat sides comprise an outward-facing multiple-wedge shape.

11. The airborne noise reduction device of claim 1, wherein the acoustic insulative material comprises one of rock wool, soundproof foam, and glass wool.

* * * * *